United States Patent [19]

Campos et al.

[11] Patent Number: 4,900,033

[45] Date of Patent: Feb. 13, 1990

[54] SPELLING GAME APPARATUS

[76] Inventors: Samuel Campos; Raoul Campos-Kreutzer, both of 3810 King St., Alexandria, Va. 22302

[21] Appl. No.: 242,972

[22] Filed: Sep. 12, 1988

[51] Int. Cl.[4] ..... A63F 3/00

[52] U.S. Cl. ..... 273/249

[58] Field of Search ..... 273/249, 243, 244, 272

[56] References Cited

U.S. PATENT DOCUMENTS

| | | | |
|---|---|---|---|
| 1,525,944 | 2/1925 | Marteka | 273/243 |
| 4,000,897 | 1/1977 | York | 273/244 |
| 4,029,320 | 6/1977 | Hausman | 273/249 |
| 4,272,080 | 6/1981 | Breslin | 273/249 |
| 4,640,513 | 2/1987 | Montijo | 273/249 |

FOREIGN PATENT DOCUMENTS

| | | | |
|---|---|---|---|
| 1129581 | 10/1968 | United Kingdom | 273/249 |

*Primary Examiner*—William H. Grieb
*Assistant Examiner*—Benjamin Layno
*Attorney, Agent, or Firm*—Banner, Birch, McKie & Beckett

[57] ABSTRACT

A game apparatus for entertaining children and teaching them how to spell. The gameboard thereof has first and second paths thereon from a starting location to a finishing location thereof. The paths are defined by a plurality of ordered spaces or steps. The player moves his game piece along the paths as directed by a chance device, any special instructions on any of the steps on which he lands and whether he correctly spells the word or words from a list of words associated with those steps. If a player lands his game piece on a special designated step and correctly spells the word(s) associated with that designated step, he automatically jumps his game piece ahead along the path, i.e. proceeds along a second shorter path, towards the finishing location. When one player's turn has passed and it is another player's turn, the one player can study the list of words to prepare for his next turn.

30 Claims, 4 Drawing Sheets

FIG. 9
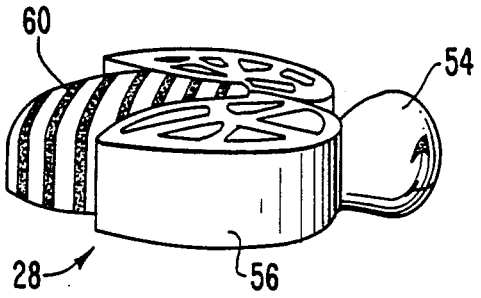
FIG. 11
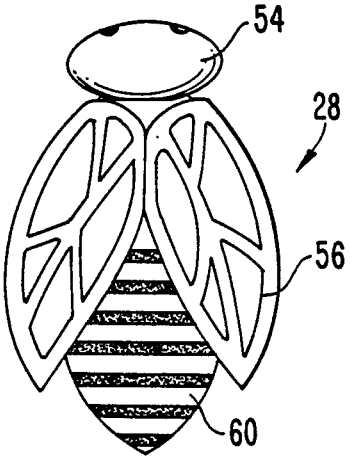
FIG. 10
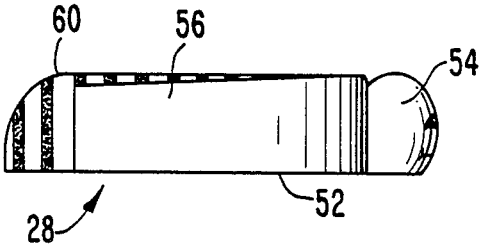
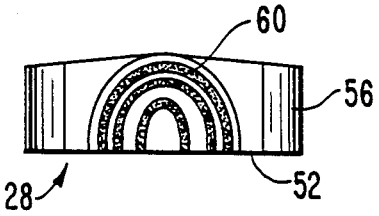
FIG. 12
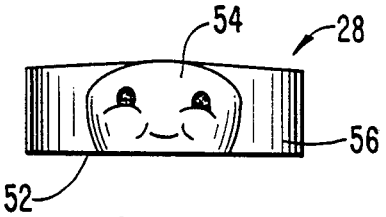
FIG. 13

FIG. 14

LEVEL 1

1 ACADEMIC
2 ACOUSTICAL
3 BABOON
4 BACKSTROKE
5 CALCIUM
6 CALENDAR
7 DANGEROUS
8 DECEASED
9 EARNEST
10 EVERLASTING
11 FACTUAL
12 FRACTION
13 GALACTIC
14 HAIRCUT
15 HIGHLIGHT
16 IGNITION
17 INJURE
18 JACKRABBIT
19 KEEPSAKE
20 LAKEFRONT
21 MIGHTY
22 NAGGING
23 OBEDIENT
24 PACIFIC
25 QUARTERBACK
26 RADIANT
27 SAGEBRUSH
28 TACKLE
29 UMBRELLA
30 VACATIONLAND
31 WAISTBAND
32 YARDAGE
33 ZEALOUS

BRIDGE WORDS

ACCREDITATION
CAMOUFLAGED
DISCOLORATION
GOLDENFLEECE
ISOMORPHIC
ABYSMALLY
ARBUSTUM 62 66 70 74

FIG. 15

LEVEL 2

1 ADJACENT
2 ADMINISTER
3 BANISHMENT
4 BALSAM
5 CANOPY
6 CARBONATE
7 DECEITFUL
8 DEFINITE
9 EDUCATION
10 EXAMPLE
11 FAINT
12 FREESTYLE
13 GARMENT
14 HAMMERING
15 HISTORIC
16 ILLUSION
17 INMATE
18 JADED
19 KERCHIEF
20 LANTERN
21 MAGICAL
22 NASTINESS
23 OCCUPATION
24 PANELIST
25 QUAVER
26 RADIOACTIVE
27 SAUSAGE
28 TAWNE
29 UNDERGROWTH
30 VAGRANCY
31 WATTAGE
32 YEARNING
33 ZIGZAG

BRIDGE WORDS

ANTICIPATION
CHALLENGING
DOMINEERING
GROUCHINESS
JASMINEWOOD
ACRIMONIOUS
ARTHROSCOPY 64 68 72 76

SPELLING GAME APPARATUS

BACKGROUND OF THE INVENTION

The present invention relates to board games and more particularly to board games which not only entertain but also serve an educational purpose. This invention further relates to game methods for teaching children how to spell.

Many different types and varieties of board games are known. While many involve strictly luck or chance in determining the winner of the game, others involve an element of skill. Some board games further have an educational object and value to them. However, there are no known board games which, while having an educational purpose in that they teach children how to spell, also are entertaining and involve an element of luck or chance in determining the winner.

SUMMARY OF THE INVENTION

Accordingly, it is a principal object of the present invention to provide a new board game which has both entertaining and educational benefits.

It is a further object of the present invention to provide a new board game which teaches children (or adults) how to spell while entertaining them.

It is a still further object of the present invention to provide a new board game which has an attractive and unique playing game board and playing game pieces.

A further object is to provide a unique educational game which can be easily learned, played and enjoyed by people of generally all ages.

Directed to achieving these objects, the present invention provides a new board game which challenges the players' spelling ability and also serves a teaching purpose. This spelling game includes a gameboard, a game piece for each of the players, and a number of list of different words to be spelled by the players. The gameboard is configured to resemble a beehive and has a starting location and a finishing location. The finishing location is surrounded by a spiral of hexagonally-shaped steps or spaces. The steps are ordered and numbered to provide a first path from the starting to finishing locations. On at least one of the steps there is an indication of a "bridge" or jumping movement opportunity. In other words, when the player lands his game piece on that designated step and correctly spells one or more of the words from the list associated with that step he will then advance over the bridge to another advanced step thereby bypassing the intervening steps. This thereby defines a second path from the starting to the finishing locations which is shorter, i.e., has fewer steps, than the first path. A spinner is provided having a number of sides with indications on each of the sides of the movement to be made, if any, by the game piece of the player who has spun the spinner. The player moves his game piece forwards (or backwards) along the path as directed by the indication showing on the spinner to a next step. The player must then correctly spell the word from the list of words which corresponds to that next step. If he does not correctly spell the word then he must move back three spaces on the gameboard. If he correctly spells it then he remains at that step and it is the next player's turn to spin, move, spell, and so forth.

Other objects and advantages of the present invention will become apparent to those persons having ordinary skill in the art from the foregoing description taken in conjunction with the accompanying drawings.

BRIEF DESCRIPTION OF THE DRAWINGS

FIG. 9 is a perspective view of a game piece of the game of FIG. 1.

FIG. 10 is a side elevational view of the game piece of FIG. 9.

FIG. 11 is a top plan view of the game piece of FIG. 9.

FIG. 12 is a rear elevational view of the game piece of FIG. 9.

FIG. 13 is a front elevational view of the game piece of FIG. 9.

FIG. 14 is a front view of the first card list of the game of FIG. 1.

FIG. 15 is a front view of the second card list of the game of FIG. 1.

DETAILED DESCRIPTION OF PREFERRED EMBODIMENTS OF THE PRESENT INVENTION

Figure 1:
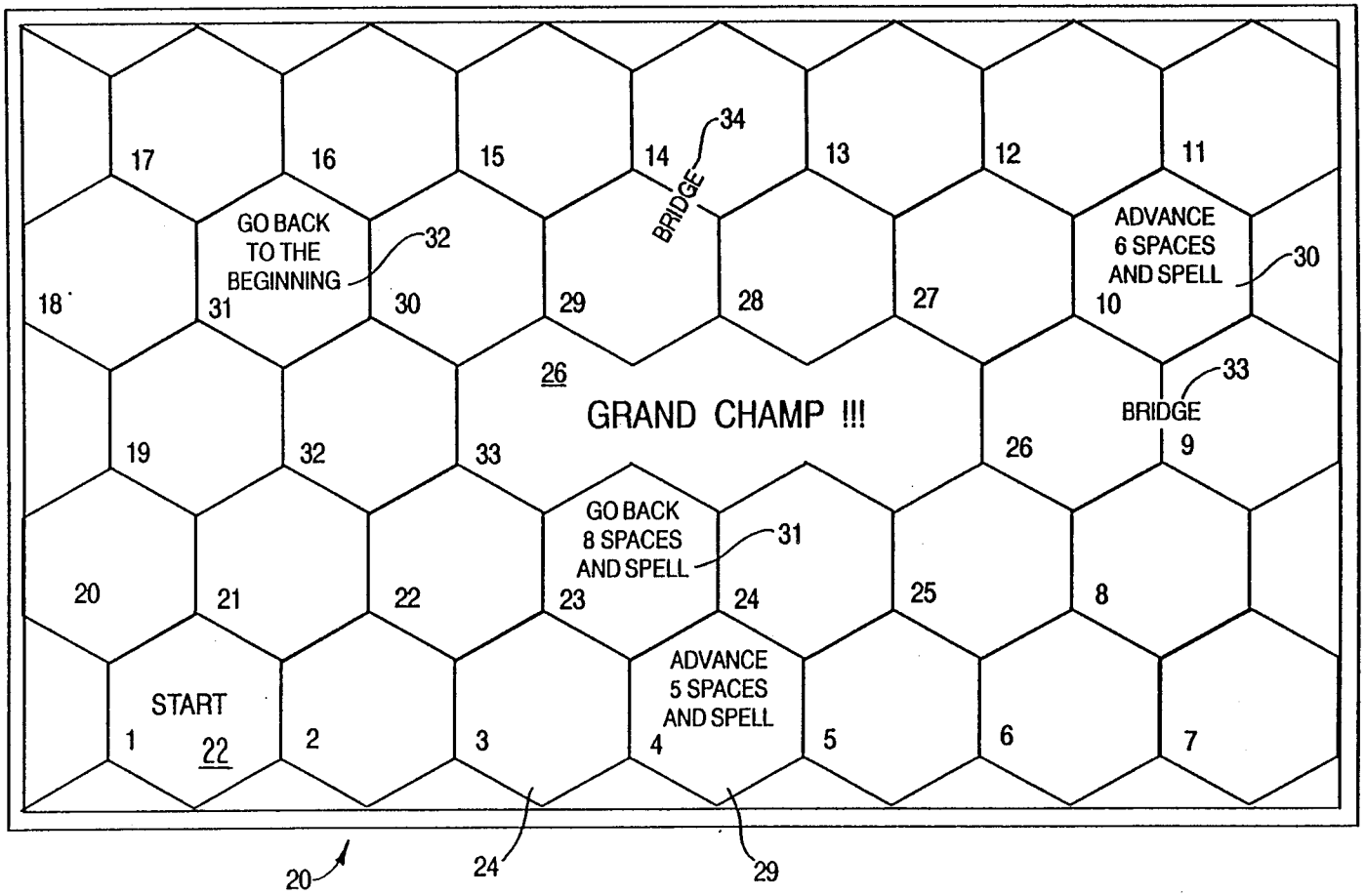
FIG. 1 is a top plan view of the gameboard of a spelling game of the present invention.
Figure 2:
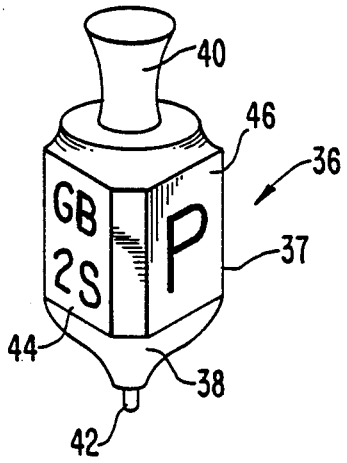
FIG. 2 is a perspective of the spinner of the game of FIG. 1.
Figure 3:
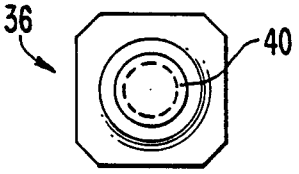
FIG. 3 is a top plan view of the spinner of FIG. 2.
Figure 4:
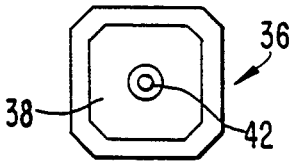
FIG. 4 is a bottom plan view of the spinner of FIG. 2.
Figure 5:
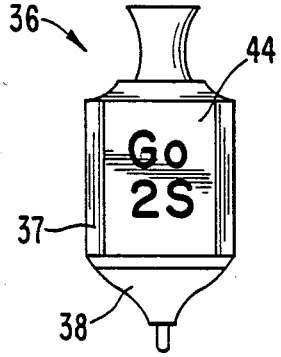
FIG. 5 is a side elevational view of a first side of the spinner of FIG. 2.
Figure 6:
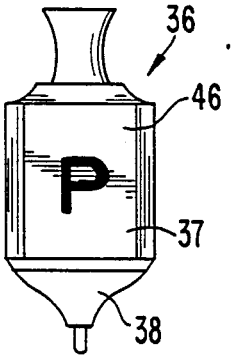
FIG. 6 is a side elevational view of a second side of the spinner of FIG. 2.
Figure 7:
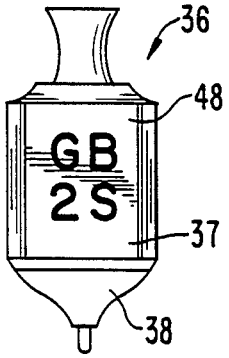
FIG. 7 is a side elevational view of a third side of the spinner of FIG. 2.
Figure 8:
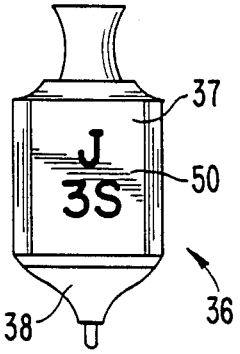
FIG. 8 is a side elevational view of a fourth side of the spinner of FIG. 2.

A gameboard of the present spelling game invention is shown generally at 20 in FIG. 1. It is a generally flat board made from cardboard or the like and can have a crease (not shown) longitudinally (or laterally) thereacross along which the gameboard 20 can be folded to facilitate compact storage thereof. The gameboard 20 has a playing surface which is configured to generally resemble a beehive. In one corner a starting location 22 is identified and labeled step #1. Each of these steps shown for example at 24 is hexagonally configured and they are #1–33. It is noted that the numbers define a spiral path from the starting location 22 to the finishing location 26 which is identified as the "Grand Champ !!!" #33. The spaces or steps 24 are consecutively numbered to direct the movement of the game pieces, shown generally at 28 in FIGS. 9–13, on the playing surface of the gameboard 20.

Some of the spaces or steps 24 have special instructions on them. For example, in space #4 as shown by reference numeral 29 there is an instruction to "Advance 5 Spaces and Spell", in space #10 as shown by reference numeral 30 to "Advance 6 Spaces and Spell", in space #23 as shown by reference numeral 31 to "Go Back 8 Spaces and Spell", and in space #31 as shown by reference numeral 32 to "Go Back to the Beginning" or starting location 22. Similarly, between spaces #9 and #26 and #14 and #29 there are "Bridge" indicators 33 and 34, respectively, which indicate that the game piece 28 can move across the bridge under certain circumstances to be explained later and thereby bypass the intervening spaces. This short cut path across bridge indicator 33 then defines a second path (defined by spaces #1–9 and 26–33) which is shorter than the first path from the starting location 22 to the finishing location 26 (spaces #1–33). Similarly, a third shorter path is defined when bridge indicator 34 is traversed, that is from spaces #1–14 and 29–33. It is also within the scope of this invention to include additional indicators which direct the game pieces landing thereon to move forwards or backwards or even to remain there for one or more playing turns.

The movement of the game pieces 28 along the paths of the gameboard 20 is also directed by the instructions shown by a chance device, which preferably takes the form of a spinner shown generally at 36 in FIGS. 2–8. The spinner 36 includes a generally cylindrical body 37, a cone 38 extending down from the cylindrical body 37, and a stem 40 extending upwards from the body 37. When the stem 40 is grasped by the player's fingers and snapped it rotates on the tip 42 of its cone 38 and when its spinning motion ceases one of the sides 44, 46, 48, 50 of the body 35 of the spinner 36 will be on top. Each of the four sides 44, 46, 48, 50 of the spinner 36 has an abbreviated instruction on it. In a preferred embodiment of the invention these instructions would be, respectively, "GO 2 S", "P", and "GB 2 S," "J 3 S". These abbreviated instructions correspond to the following: "P" stands for pass, in other words the player that draws a P must remain idle until his or her next turn; "GO 2 S" means that the player advances his game piece 28 two spaces 24 forward and then spells the word associated with that step; "J 3 S" means that the player jumps his game piece 28 three spaces 24 and then spells the word associated with the step on which he lands; and "GB 2 S" means that the player moves his game piece 28 back two spaces and spells. Any other type of chance device, such as randomly-ordered instruction cards (not shown) or dice (not shown), can be used in lieu of the spinner 36.

The game pieces 28 are shown in FIGS. 9–13, and resemble sitting bees resting on a flat bottom surface 52 thereof. The bee's head is shown at 54, his wings at 56, and his body at 60. To differentiate each of these playing pieces they can be painted different colors. One example is to paint only the bodies 60 thereof different colors and to have the wings 56 and head 54 remain the same color or colors. The different colors are used to help the players identify their respective game pieces. The design of the game piece 28 as a bee fits within the general spelling bee theme of this invention which is also reinforced by the beehive configuration of the playing surface of the gameboard 20.

The lists of words to be spelled are shown in FIGS. 14 and 15 at 62 and 64, respectively. As seen they simply comprise elongated cards 66, 68 comprising long lists 70, 72 at the top with each being consecutively numbered and preferably alphabetically ordered and shorter list 74, 76 at the bottoms thereof labeled "Bridge Words". Each of the numbers on this list corresponds to the numbers of each of the steps 24 of the paths on the gameboard 20. When a game piece 28 lands on a numbered step then one of the opposing players (or a neutral person) will ask the player whose game piece 28 landed on that step to spell the word or words on the list 70, 72 corresponding to the number of the space. If the player fails to spell this word correctly, then he must move his game piece 28 back three spaces on the gameboard 20. On the other hand, if he spells it correctly he remains on that step and then the next player takes his turn.

If a game piece 28 lands on one of the "bridge" steps #9 and #14, as shown respectively by reference numerals 33 and 34, then that player will be asked to spell the words from the "Bridge Word" portions 74, 76 of the lists 62, 64. If he or she spells correctly any three of those words, then he can advance across the Bridge to the indicated steps. No penalty is imposed for misspelling one of these words, however, in a preferred form of this invention.

Thus, the instructions for playing the spelling game of the present invention are rather simple, and thus the players' time can be spent actually playing the game and spelling the words instead of struggling to learn how to play it. Simply, the object of the game is for each player using one of the game pieces 28 to start in the starting location 22 or space #1 of the gameboard 20 and then to move across the gameboard 20 along the first or second or third paths until he reaches the finishing location 26, which is shown in FIG. 1 as the "Grand Champ !!!" space #33.

To start, the gameboard 20 is opened along its crease into its flat configuration. Each of the players selects a different spelling bee game piece 28 and places it on the starting location 22 of the gameboard 20. One of the game cards 66, 68 is selected, and one of the players chosen to go first. This player could for example be the youngest of the players. After this player has completed his turn the turn follows in succession to the next player to his or her left. The next player will be holding game card 66 (or 68) for the player whose turn it is.

The first player rotates the spinner 36 with his finger tips at the stem 40 on the surface of the gameboard 20. When its motion stops the player takes his or her spelling bee game piece 28 across the gameboard 20 as directed on the then top side 44, 46 48 or 50 of the spinner 36. The player on his or her left matches the number of the gameboard spaces 24 where the spelling bee game piece 28 lands with the word number on the game card 66 or 68. He quizzes the first player as to the correct spelling of that particular word. If the player fails to spell the word correctly his game piece 28 then must move backwards (toward the starting location 22) three spaces on the gameboard 20. On the other hand, if he spells the word correctly, then the next or second player takes the spinner 36 and the following player to his or her left takes the game card 66(or 68). Each player then takes his or her turn and the game continues in the same manner as the initial step.

During the course of the game, a spelling bee game piece 28 can land on one of the specially marked spaces, such as the "Bridge" spaces 33 or 34 or the indicator spaces 29, 30, 31 or 32. When the player lands his game piece 28 on the Bridge space #9 or #14, he has the opportunity to advance to a higher space after he or she has spelled correctly any three of the bridge words from he lower part 74 (or 76) of the game card 66(or 68) being used. As mentioned above, there is no penalty when one of these bridge words is misspelled pursuant to a preferred form of this game. When the player lands on the "Go Back" space 31 (or 32), he must take his spelling bee game piece to the indicated space.

The game is completed when, the first player reaches the "Grand Champ!!!" step 26 on the gameboard 20. Alternatively, it can continue until all the players reach this final space #33, finishing location 26. The game may also continue with a different game card (for example 68 instead of 66) to be used by all the players who have advanced to the "Grand Champ!!!" space. This is done by taking the spelling bee game pieces 28 back to the starting location 22 (space #1) on the gameboard 20 and repeating the game but with a different game card such as 68. These game cards will preferably each contain words of similar spelling difficulty, and different game cards would contain words of different spelling difficulty. The game can also be played by having a third player who would quiz the players on the spelling of the words and would be the only one to see the game card. However, by using the same game card and passing it between or among the players it allows each of the players to review and learn the spelling of the words on it to encourage and improve the players' spelling abilities. Alternatively, each player can have a separate game card with different words on it and then on one player would be able to see the other game card which has or lists the words which he must spell. This, at first blush may seem to be the fairer way of playing the game because the players would not be able to review the words on the game card when it was another player's turn. However, a very important purpose of this game is to teach the children players the spellings of many new words, and this reviewing or studying opportunity enhances that purpose.

Thus, this spelling game is unique and is very easy to learn to play. The learning process is made very enjoyable and easy and is enhanced while playing the game.

From the foregoing detailed description, it will be evident that there are a number of changes, adaptations, and modifications of the present invention which come within the province of those persons skilled in the art. However, it is intended that all such variations not departing from the spirit of the invention be considered as within the scope thereof as limited solely by the claims appended hereto.

What is claimed is:

1. A spelling game apparatus to be played by at least first and second players, comprising:

a gameboard having a playing surface depicting a starting location, a finishing location, a first path from said starting location to said finishing location, and a second path from said starting location to said finishing location, said first path being defined by a first plurality of steps at least one of said steps of said first path defining a designated step, said second path being defined by a second plurality of steps, which is fewer than said first plurality of steps;

a first game piece for a first player;

a second game piece for a second player;

a chance means for directing the movement of said first and second game pieces along said steps of at least one of said first and second paths;

a list of words at least one of the words of said list is to be spelled by the first or second players, depending on which of said steps of said first or second paths said first or second game pieces land, said list of words including a first set of words associated with at least most of the steps of said first path and a different second set of words associated with said designated step, said first and second sets being of different spelling difficulties; and an indicating means associated with said designated step for indicating, when said first game piece lands on said designated step and the first player correctly spells at least one of the words, of said list, associated with said designated step, that said first game piece can then advance along said second path towards said finishing location.

2. The spelling game apparatus of claim 1 wherein said steps of said first and second paths are coincident starting location and said designated step.

3. The spelling game apparatus of claim 2 wherein said designated steps defines a first designated step, and said first game piece which has landed on said first designated step and then proceeds along said second path lands on a second designated step thereof, said first path including more of said first path steps between said first and second designated steps than said second path includes of said second path steps between said first and second designated steps.

4. The spelling game apparatus of claim 3 wherein said second designated steps lies on both said first and second paths.

5. The spelling game apparatus of claim 1 wherein said gameboard has a gameboard edge and a gameboard center, said starting location lies generally at said gameboard edge and said finishing location lies generally at said gameboard center, and said first and second paths spiral about and inward toward said finishing location.

6. The spelling game apparatus of claim 5 wherein said gameboard has a gameboard corner and said starting location is at said gameboard corner.

7. The spelling game apparatus of claim 1 wherein said first and second game pieces are in the shape of resting bees having lower gameboard resting surfaces.

8. The spelling game apparatus of claim 1 wherein said chance means comprises a spinning element having a plurality of sides at least two of which have an indicator which indicates how many steps, if any, and in which direction said first or second game pieces are to move along said first or second paths, after having been spun and indicating one of said sides.

9. The spelling game apparatus of claim 8 wherein said spinning element sides comprise first, second and third sides, and said indicators comprise corresponding to said three sides first, second and third indicators, said first indicator indicating that said first or second game piece not proceed, said second indicator indicating that said first or second game piece proceed at least one space back towards said starting location and said third indicator indicating that said first or second game piece proceed at least one space forward to said finishing location.

10. The spelling game apparatus of claim 1 wherein a plurality of said steps of said first and second paths each include separate number indicators indicating which of the words of said list is or are to be spelled by the first player when the first game piece lands on said step or by the second player when said second game piece lands on said step.

11. The spelling game apparatus of claim 1 wherein at least one of said steps of said first or second paths has an instructor associated therewith instructing the player whose said game piece lands thereon as directed by said chance means to move backwards along said first or second paths towards said starting location.

12. The spelling game apparatus of claim 1 wherein said word indicators comprise different symbols associated with each of said steps and positioned on said gameboard and corresponding symbols associated with words on said list and positioned on said list.

13. The spelling game apparatus of claim 1 wherein said lists includes a group of words which are the same words to be spelled for both the first and second players.

14. The spelling game apparatus of claim 1 wherein said list of words is imprinted vertically on at least one elongated game card.

15. The spelling game apparatus of claim 1 wherein generally all of said steps of said first plurality of steps are each hexagonally shaped.

16. The spelling game apparatus of claim 15 wherein said hexagonally-shaped steps abut one another and are positioned in aligned adjacent rows.

17. The spelling game apparatus of claim 16 wherein said starting location is in one corner of said playing surface and said finishing location is in the middle of said playing surface, and said first path spirals about and towards said finishing location from said starting location.

18. The spelling game apparatus of claim 17 wherein said rows comprise an odd number of rows with said finishing location being in the middle of the middle of said rows.

19. The spelling game apparatus of claim 18 wherein said odd number of rows comprises five rows.

20. The spelling game apparatus of claim 17 wherein said finishing location has the outer boundaries thereof shaped like three longitudinally abutting hexagons.

21. The spelling game apparatus of claim 17 wherein said indicating means indicates that the first player can move said first game piece from said designated step to a step of said first path which is inwardly adjacent thereto and physically closer to said finishing location.

22. The spelling game apparatus of claim 1 wherein said second set of words are more difficult to spell than said first set of words.

23. The spelling game apparatus of claim 1 wherein said second set of words comprises a plurality of subsets of at least two words which must be spelled correctly by the player whose said game piece lands on the associated said step.

24. A spelling game apparatus to be played by at least first and second players, comprising:

a gameboard having a playing surface depicting a starting location, a finishing location, a first path from said starting location to said finishing location, and a second path from said starting location to said finishing location, said first path being defined by a first plurality of steps, at least one of said steps of said first path defining a designated step, said second path being defined by a second plurality of steps, which is fewer than said first plurality of steps, and generally all of said steps of said first plurality of steps being hexagonally shaped;

a first game piece for a first player;

a second game piece for a second player;

a chance means for directing the movement of said first and second game pieces along said steps of at least one of said first and second paths, said chance means including at least alternative first, second and third indicators, each having different instruction for the movement of said game pieces along at least said first path, said first indicator indicates that said first or second game pieces not proceed, said second indicator indicates that said first or second game pieces proceed at least one step back towards said starting location, and said third indicator indicates that said first or second game pieces proceed at least one step forward to said finishing location.

a list of words at least one of the words of said list is to be spelled by the first or second players, depending on which of said steps of said first or second paths said first or second game pieces land; and an indicating means associated with said designated step for indicating, when said first game piece lands on said designated step and the first player correctly spells at lest one of the words, of said list, associated with said designated step, that said first game piece can then advance along said second path towards said finishing location.

25. The spelling game apparatus of claim 28 wherein said list includes a first group of words and a second group of words which are generally more difficult to be spelled and are associated with generally different said steps than said first group.

26. The spelling game apparatus of claim 25 wherein said first group of words is associated with steps of said first path and said second group of words is associated with said designated step.

27. A spelling game apparatus to be played by at least first and second players, comprising:

a gameboard having a playing surface depicting a starting location, a finishing location, a first path from said starting location to said finishing location, and a second path from said starting location to said finishing location, said first path being defined by a first plurality of steps at least one of said steps of said first path defining a designated step, said second path being defined by a second plurality of steps, which is fewer than said first plurality of steps;

a first game piece for a first player;

a second game piece for a second player;

a chance means for directing the movement of said first and second game pieces along said steps of at least one of said first and second paths, said chance means comprising a spinning element having a plurality of sides at least two of which have indicators which indicate how many steps, if any, and in which direction said first or second game pieces are to move along said first or second paths, after having been spun and indicating one of said sides;

a list of words at least one of the words of said list is to be spelled by the first or second players, depending on which of said steps of said first or second paths said first or second game pieces land, said list including a first group of words and a second group of words which are generally more difficult to be spelled than and are to be used at a different time than said first group; and an indicating means associated with said designated step for indicating, when said first game piece lands on said designated step and the first player correctly spells at least one of the words, of said list, associated with said designated step, that said first game piece can then advance along said second path towards said finishing location.

28. The spelling game apparatus of claim 27 wherein said spinning element sides comprise first, second and third sides, and said indicators comprise corresponding to said three sides first, second and third indicators, said first indicator indicating that said first or second game piece not proceed, said second indicator indicating that said first or second game piece proceed at least one space back towards said starting location, and said third indicator indicating that said first or second game pieces proceed at least one space forward to said finishing location.

29. A spelling game apparatus to be played by at least first and second players, comprising:

a gameboard having a playing surface depicting a starting location, a finishing location, a first path from said starting location to said finishing location, and a second path from said starting location to said finishing location, said first path being defined by a first plurality of steps at least one of said steps of said first path defining a designated step, said second path being defined by a second plurality of steps, which is fewer than said first plurality of steps;

a first game piece for a first player;

a second game piece for a second player;

a chance means for directing the movement of said first and second game pieces along said steps of at least one of said first and second paths;

a list of words at least one of the words of said list is to be spelled by the first or second players, depending on which of said steps of said first or second paths said first or second game pieces land; and an indicating means associated with said designated step for indicating, when said first game piece lands on said designated step and the first player correctly spells at least one of the words, of said list, associated with said designated step, that said first game piece can then advance along said second path towards said finishing location;

wherein said chance means directs the movement of said first game piece along at least one said first and second paths such that said first game piece moves backwards from the step on which it lands along said path towards said starting location if the first player does not correctly spell the word of said list associated with said step on which said first game pieces lands.

30. The spelling game apparatus of claim 29 wherein said chance means includes first, second and third indicators each having different instructions for the movement of said game pieces along at least said first path.

* * * * *